US005114151A

United States Patent [19]

Bergerstock

[11] Patent Number: 5,114,151

[45] Date of Patent: May 19, 1992

[54] RACE GAME APPARATUS

[76] Inventor: Dana D. Bergerstock, Box 676 Laraway Rd., Cayuga, N.Y. 13034

[21] Appl. No.: 772,168

[22] Filed: Oct. 7, 1991

[51] Int. Cl.[5] ..... A63F 3/00

[52] U.S. Cl. ..... 273/246; 273/281; 273/287

[58] Field of Search ..... 273/249, 244, 248–254, 273/243

[56] References Cited

U.S. PATENT DOCUMENTS

| | | | |
|---|---|---|---|
| 2,852,260 | 9/1958 | Caffrey | 273/249 |
| 3,033,572 | 5/1962 | Thibault | 273/243 |
| 3,963,243 | 6/1976 | Contento | 273/246 |
| 4,550,917 | 11/1985 | Ferris et al. | 273/246 |
| 4,913,443 | 4/1990 | Currey | 273/244 |

FOREIGN PATENT DOCUMENTS

| | | | |
|---|---|---|---|
| 373807 | 3/1907 | France | 273/246 |

*Primary Examiner*—Benjamin Layno
*Attorney, Agent, or Firm*—Leon Gilden

[57] ABSTRACT

A race game includes an oval track structure arranged with a plurality of contiguous concentric tracks, wherein the tracks each include a plurality of spaces. The game includes tokens and die members, and wherein each of the spaces is formed with contrasting enumeration in associated with the die members, wherein players in turn direct respective tokens along the spaces in diametrical, horizontal, and straight-line orientations to correspond to a movement of a token from adjacent enumerated spaces corresponding to enumerated spaces directed by the die members. A plurality of the spaces are associated with directional cards of reward and punishment types to introduce an element of change into play of the game.

3 Claims, 4 Drawing Sheets

ROLLING RACERS

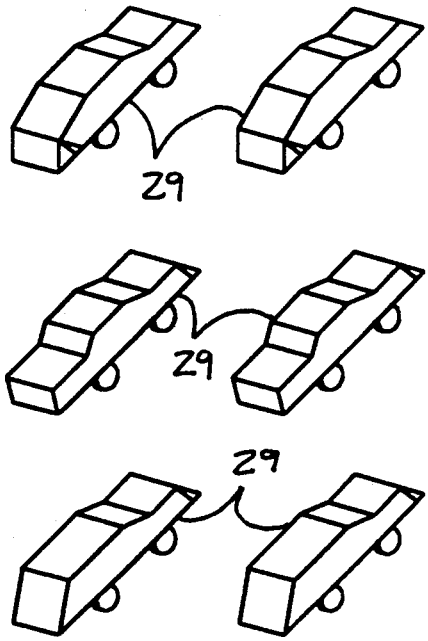
Fig 4
Fig 5
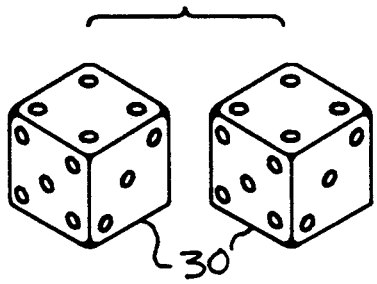
Fig 6
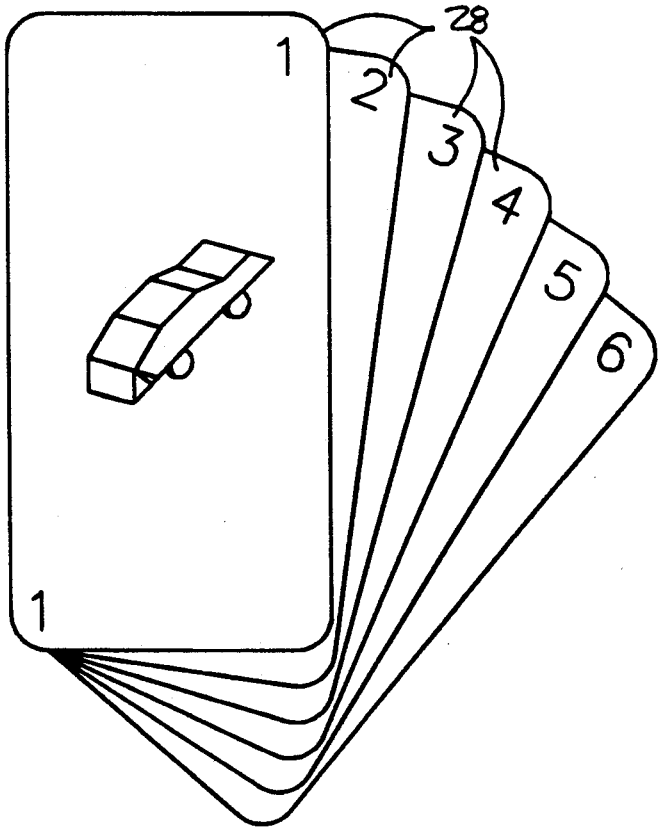

LOSE-1-TURN
OTHERS KEEP POSITION
LAST ALONE-FREE ROLL

27

Fig 7

MOTOR SKIPPING-
-ROLL BOTH DIE-
TOTAL UNDER 7-BLOWN ENGINE
OUT OF RACE
7-NO CHANGE
8 OR ABOVE-LOSE 1 TURN

27

Fig 8

BEST MOVE
OF THE DAY !!!
3 SPACES FORWARD

27

Fig 9

MOVE 1 DIAGONAL
SPACE FORWARD

27

Fig 10

OUTSIDE BRAKES STICKS
SENDS CAR DIAGONAL
INTO OUTSIDE WALL
TAKING OTHERS WITH YOU

27

Fig 11

IT'S YOUR DAY !!!

CAR IS HOOKED-UP
FREE ROLL

27

Fig 12

BLACK FLAGGED

MOVE DIRECTLY IN BACK
OF LAST CAR

27

Fig 13

ROLL-1-DIE
EVEN-ADVANCE 1 SPACE
FORWARD
ODD-LOSW 1 TURN

27

Fig 14

ADVANCE 2 SPACES
YOUR CHOICE

27

Fig 15

SPUN ON OIL PATCH
GO DIRECTLY OFF TRACK
TOWARDS INSIDE
TAKING OTHERS WITH
YOU

27

Fig 16

RACE GAME APPARATUS

BACKGROUND OF THE INVENTION

1. Field of the Invention

The field of invention relates to race game apparatus, and more particularly pertains to a new and improved race game apparatus wherein the same is arranged to direct a plurality of tokens about a race course to correspond to reality of racing.

2. Description of the Prior Art

Race game apparatus of various types have been utilized to direct various tokens and players relative to one another about a game path. Such apparatus is exemplified in U.S. Pat. No. 4,010,956 to Zyla, et al. wherein a drag racing game apparatus includes parallel lanes to simulate a drag racing event.

U.S. Pat. No. 4,917,386 to Tozer wherein a race simulation game is provided, wherein racing lanes are divided in equal number of advancement spaces, with dice utilized to determine advancement of various tokens about the spaces.

U.S. Pat. No. 4,049,274 to Jevons sets forth a motorcycle team racing game to simulate a motorcycle racing event in a cross country environment.

As such, it may be appreciated that there continues to be a need for a new and improved face game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of race game apparatus now present in the prior art, the present invention provides a race game apparatus wherein the same is utilized to direct tokens in traverse of a game race course permitting the tokens to traverse diagonally, horizontally, and in a straight-line manner about the game path of a plurality of game paths. As such, the general purpose of the present invention, which will be described subsequently in greater detail, is to provide a new and improved race game apparatus which has all the advantages of the prior art race game apparatus and none of the disadvantages.

To attain this, the present invention provides a race game including an oval track structure arranged with a plurality of contiguous concentric tracks, wherein the tracks each include a plurality of spaces. The game includes tokens and die members, and wherein each of the spaces if formed with contrasting enumeration in association with the die members, wherein players in turn direct respective tokens along the spaces in diametrical, horizontal, and straight-line orientations to correspond to a movement of a token from adjacent enumerated spaces corresponding to enumerated spaces directed by the die members. A plurality of the spaces are associated with directional cards of reward and punishment types to introduce an element of chance into play of the game.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved race game apparatus which has all the advantages of the prior art race game apparatus and none of the disadvantages.

It is another object of the present invention to provide a new and improved race game apparatus which may be easily and efficiently manufactured and marketed.

It is a further object of the present invention to provide a new and improved race game apparatus which is of a durable and reliable construction.

An even further object of the present invention is to provide a new and improved race game apparatus which is susceptible of a low cost of manufacture with regard to both materials and labor, and which accordingly is then susceptible of low prices of sale to the consuming public, thereby making such race game apparatus economically available to the buying public.

Still yet another object of the present invention is to provide a new and improved race game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1*a* is an orthographic view, taken along the lines 1*a*—1*a* of FIG. 1 in the direction indicated by the arrows.

FIG. 1*b* is an orthographic cross-sectional illustration of the pivot plate of the game board in a raised orientation relative to the lowered orientation, as set forth in FIG. 1*a*.

FIG. 4 is an isometric illustration of the various game tokens utilized by the instant invention.

FIG. 5 is an isometric illustration of the die members of the instant invention of a predetermined number of sides.

FIG. 6 is an orthographic top view of the predetermined number of pole position cards.

FIGS. 7–16 are top orthographic views of the directional cards utilized by the invention.

DESCRIPTION OF THE PREFERRED EMBODIMENT

Figures 1, 2, 2A, 2B:
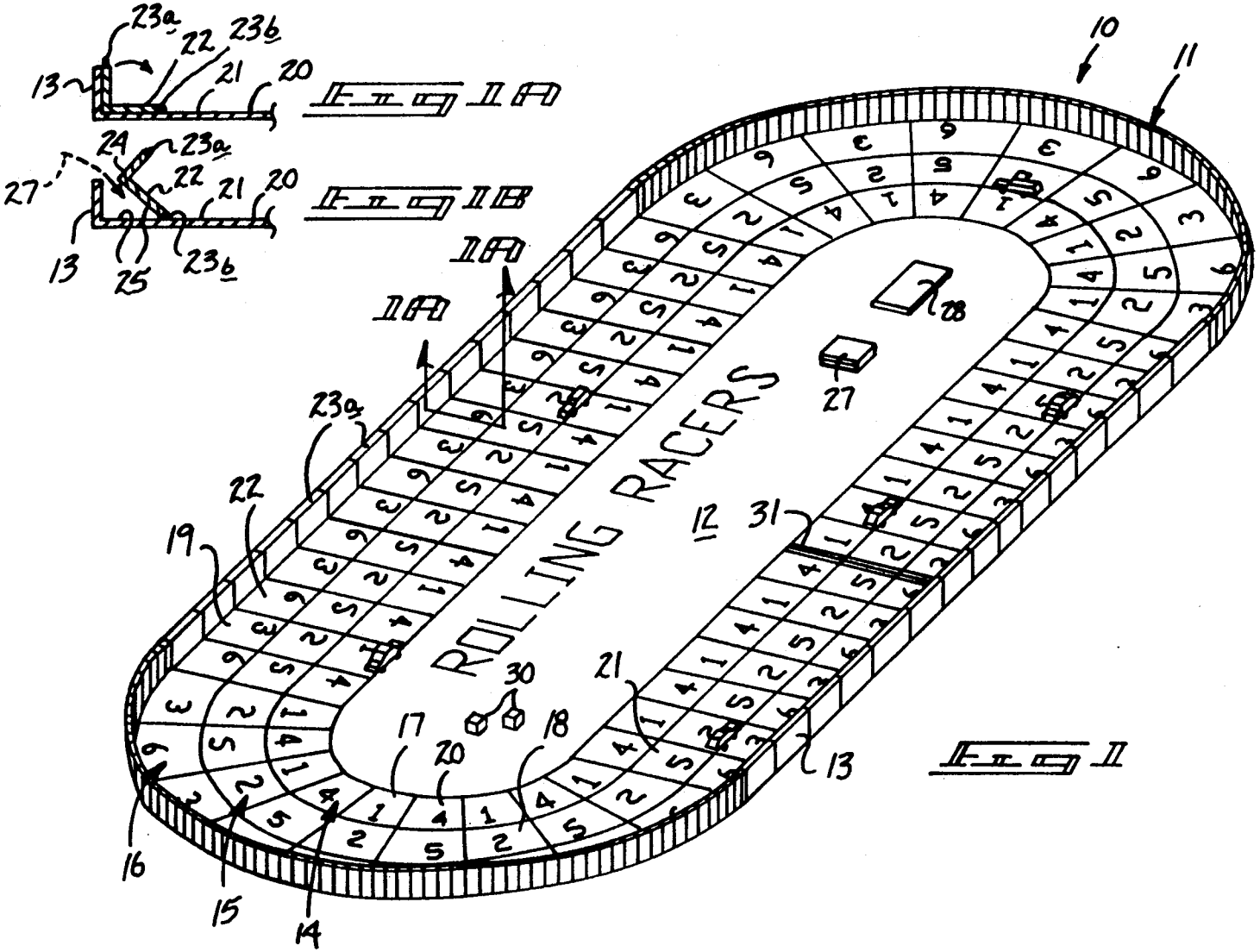
FIG. 1 is an isometric illustration of the game board of the instant invention.
FIG. 2 is an orthographic top view of the race course as set forth by the invention.
Figure 2:
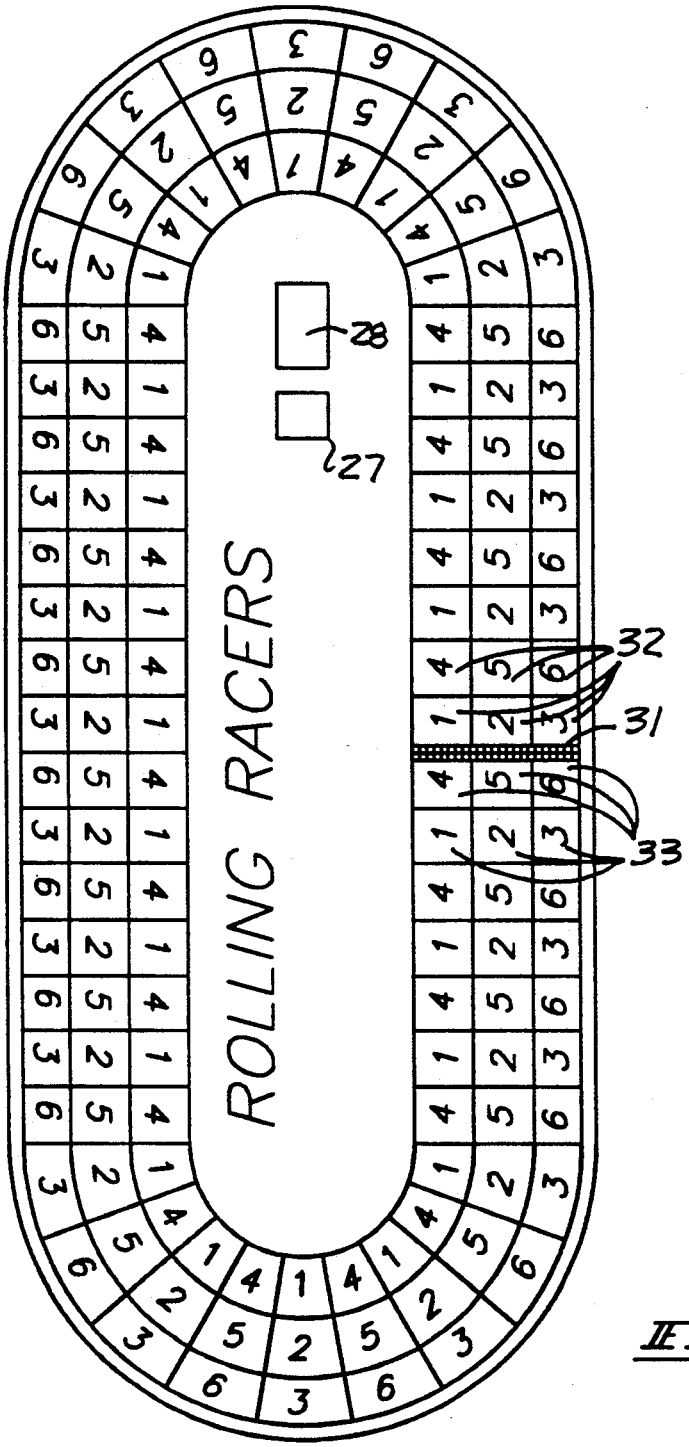
Figure 3:
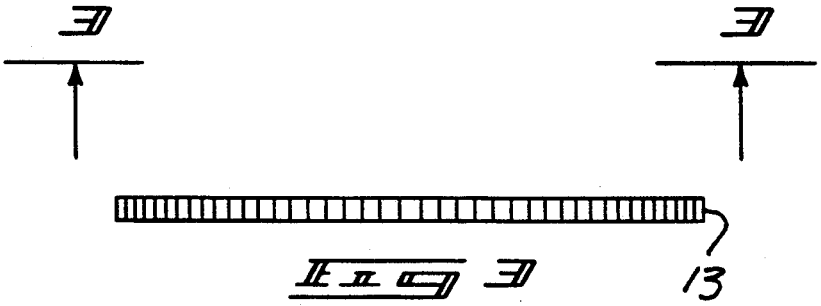
FIG. 3 is an orthographic view, taken along the lines 3—3 of FIG. 2 in the direction indicated by the arrows.

With reference now to the drawings, and in particular to FIGS. 1–16 thereof, a new and improved race game apparatus embodying the principles and concepts of the present invention and generally designated by the reference numeral 10 will be described.

More specifically, the race game apparatus 10 of the instant invention essentially comprises a game board 11, including a central board area 12, including a respective first, second, and third path 14, 15, and 16 respectively, wherein each of the paths are of a continuous configuration in a generally contiguous concentric orientation relative to one another in a generally elongate configuration. It is understood that the paths may be of a circular, rectilinear, or any other suitable configuration requiring each of the paths to be formed of a plurality of spaces, wherein the spaces are in aligned orientation relative to one another and each of the respective paths. Respective first and fourth spaces are directed throughout the first path, respective second and fifth spaces are directed throughout the second path 15, and the respective third and sixth spaces 19 and 22 are directed throughout the third path. As illustrated, each of the spaces of each of the paths are in alternating numerical relationship relative to one another. The number of spaces are defined by a predetermined number equal to the number of sides of each of the die members 30, as illustrated in FIG. 6. As the die members as exemplified, include six faces each, six spaces are provided and divided equally among the respective first through third paths, with each of the paths accordingly including a plurality of the predetermined number of spaces in the alternating relationship as illustrated among each of the paths. An outer perimeter wall 13 is provided about the outer perimeter of the game board 11 to contain the various tokens and die members in play within the game board.

It is illustrated that a predetermined number of pole position cards 28 are provided (see FIGS. 1 and 6) to position each of the predetermined number of tokens 29 (see FIG. 4) adjacent the starting line 31 that is directed orthogonally across the paths 14–16. A plurality of first and second starting spaces 32 and 33 are provided on each side of the starting line 31, with each predetermined number of starting spaces equal to the predetermined number defined by the pole position cards 28 and the die members 30. The pole position cards 28 are initially shuffled, and it is desired that a predetermined number of players be provided and each select a card of the predetermined number of cards and each player will utilize a token in association with a chosen card and position that token in the corresponding space of the respective first and second starting spaces 32 and 33 dependent upon whether clockwise or counterclockwise direction about the 14–16 is desired. It is understood that the tokens are positioned in either the first or second starting spaces and must all be contained within either the first or second starting spaces at the outset of the race. It is the object of the game that the player or token completing a single lap about the game board is declared a winner.

To traverse the path, the die members are rolled sequentially and players direct the tokens forwardly to traverse the paths. The tokens are accordingly directed forwardly, laterally, or diagonally relative to the game paths and movement of a token is permitted as long a diagonal, lateral, or forward displacement of the token is arranged to be in contiguous communication with a space of the plurality of spaces 17–22 that a player is present upon by way of the associated token.

The die members are not added, but merely the top face of the die member as rolled on the central board area 12 is read and for example should a player be on a number 2 space and a number 4 and a 2 die designation are illustrated, the player may move diagonally from a 2 to a 4 and then from a 4 to a 2 space to direct the token forwardly. Should a player not be able to move, then that player must await a further turn. Should a player roll the same designation upon both die members, the player is then permitted a further roll of the die members. Engagement with an opponent upon a space advances the contacted opponent racer forwardly, diagonally, or sideways dependent upon whether the moving player has proceeded into the player's occupied space in a diagonal, lateral, or forward orientation. Should an opponent be directed off of the track of the first through third paths 14–16, a 1 or a 4 is needed to return in a roll of the die members 30. Alternatively, should a player be directed into the perimeter wall 13, a 3 or 6 is required before that player being exteriorly of the paths 14–16 be permitted back onto the game paths.

A first variation in use of the game wherein various of the six token spaces 22 are of contrasting coloration, whereupon a player landing upon that contrasting colored space is directed to pick up a directional card 27 of the stack of directional cards, and the directional cards are, as illustrated in the FIGS. 7–16, in directing either penalty or award to that player. Alternatively, the game board is constructed to include an "L" shaped pivot plate 23 at each of the six spaces 22, the first and second starting spaces 32 and 33 exempted. Each of the six spaces 22 includes the "L" shaped pivot plate 23, as illustrated in FIGS. 1*a* and 1*b*, and includes a vertical plate 24 and a horizontal plate 25 overlying a horizontal support surface 26 that is coextensive with and underlying the horizontal leg plate 25 that designates the six space 22 at a top surface thereof. In this manner, the directional cards are positioned under selective ones of the "L" shaped pivot plates 23, wherein each "L" shaped pivot plate 23 includes a handle 23*a* that projects above and is mounted to an upper edge of the vertical leg plate 24 to ease its lifting. Each horizontal leg plate 25 is pivoted about a pivot plate hinge 23*b*. As the ten designated directional cards 27 are arbitrarily positioned upon ten of the six spaces 22, the element of chance and surprise may be varied from one race to another in a player landing of each of the six spaces 22.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A race game apparatus, comprising in combination, a game board, the game board including a central board area, and the game board including a continuous outer perimeter wall, and at least a first, second, and third concentric continuous game paths directed about the game board between the central board area and the perimeter wall, each game path of said first, second, and third game paths including a plurality of spaces, each space having either one of a first, a second, a third, a fourth a fifth, or a sixth distinguishable indicia wherein the spaces of said first game path have alternating first and fourth indicia, wherein the spaces of said second game path have alternating second and fifth indicia, and the spaces of said third game path have alternating third and sixth indicia, and a plurality of dice, each die having said six distinguishable indicia thereon, wherein the faces of each die having one of said six distinguishable indicia, and a plurality of pole positions cards contained within the central board area for selection by a predetermined number of players, and a starting line orthogonally directed across the first, second, and third game paths, and a first plurality of starting spaces, and a second plurality of starting spaces, wherein the first and second starting spaces are positioned upon opposing sides of the starting line permitting clockwise or counter-clockwise direction of play about the first, second, and third game paths, and a plurality of tokens positioned selectively within the first or second starting spaces.

2. An apparatus as set forth in claim 1 wherein the sixth indicia spaces each includes an "L" shaped pivot plate pivotally mounted to the game board within the third game path.

3. An apparatus as set forth in claim 2 wherein each "L" shaped pivot plate includes a horizontal leg plate, the horizontal leg plate mounted to a pivot plate hinge, and the pivot plate hinge mounted at an intersection between the third and second game path, and the horizontal leg plate including a vertical leg plate fixedly and orthogonally mounted to the horizontal leg plate at a side edge thereof remote from the pivot plate hinge and parallel to the pivot plate hinge, wherein the vertical leg plate includes a handle member mounted at an upper edge of the vertical leg plate to enhance grasping of the leg plate for pivotment of the "L" shaped pivot plate, and the horizontal leg plate positioned to coextensively overlie a horizontal support space below each horizontal leg plate, with the sixth space imparted upon a top surface of the horizontal leg plate, and a plurality of directional cards, a directional card of the plurality of directional cards selectively positioned upon selective ones of the horizontal support space below the horizontal leg plate, whereupon a token landing upon a horizontal leg plate is directed to lift the "L" shaped pivot plate for accommodation of the directional card.

* * * * *